US006243899B1

(12) United States Patent
Tada

(10) Patent No.: US 6,243,899 B1
(45) Date of Patent: Jun. 12, 2001

(54) MATTRESS DEVICE

(75) Inventor: Tomonori Tada, Chiryu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/344,109

(22) Filed: Jun. 24, 1999

(30) Foreign Application Priority Data

Jun. 24, 1998 (JP) ..... 10-177697

(51) Int. Cl.[7] ..... A47C 27/10

(52) U.S. Cl. ..... 5/706; 5/654; 5/655.5; 5/909; 5/935

(58) Field of Search ..... 5/706, 707, 654, 5/655.5, 909, 935, 640, 644

(56) References Cited

U.S. PATENT DOCUMENTS 5,547,253 * 8/1996 Schwartz et al. ..... 5/935 X
5,636,395 * 6/1997 Serda ..... 5/909 X
5,737,788 * 4/1998 Castellino et al. ..... 5/655.5
5,860,705 * 6/1999 Ridder ..... 5/655.5 X

FOREIGN PATENT DOCUMENTS 63-1451 1/1988 (JP) .
2-156906 6/1990 (JP) .

* cited by examiner

*Primary Examiner*—Lynne H. Browne
*Assistant Examiner*—Fredrick Conley
(74) *Attorney, Agent, or Firm*—Burns, Doane, Swecker & Mathis, LLP

(57) ABSTRACT

A mattress includes a bag in which an amount of fluid is sealed. A portion of the bag is provided with an adjuster which adjust an inner volume of the bag. Adjusting the inner volume changes a pressure of the fluid in the bag which is regarded as a softness or hardness of the mattress. Such an adjustment is established without a supply or a drain of the fluid in and to the bag, respectively.

20 Claims, 3 Drawing Sheets

MATTRESS DEVICE

BACKGROUND OF THE INVENTION

1. Field of the Invention

The present invention is directed to a mattress, and, in particular, to a mattress in which the softness or hardness of the mattress can be changed or adjusted if desired.

2. Related Art

A typical conventional mattress of the type wherein an elasticity of the mattress depends on the property of a fluid which is sealed in a bag is disclosed in Japanese Utility Model Laid-open Print No.Sho.63(1988A.D.)-1451 or Japanese Patent Laid-open Print No.Hei.2(1990A.D.)-15 6906. In the conventional mattress, an amount of fluid is sealed in a bag on which a person lays. For adjusting the elasticity or firmness of the bag according to his/her taste, the amount of the fluid in the bag may be changed. In detail, if harder elasticity and softer elasticity are required, the fluid is supplied to and drained from the bag, respectively. Suppling fluid into the bag causes the bag to inflate to increase the elasticity of the bag, while draining fluid from the bag makes the bag deflate to decrease the elasticity of the bag.

In the foregoing conventional structure for adjusting the elasticity of the bag, the mattress includes an outside vessel that stores the fluid to be supplied to the bag or drained from the bag. In addition, the outside vessel has a meter or an instrument that indicates the quantity of fluid supplied to and drained from the bag. Moreover, sometimes a pump is needed to automatically transfer the fluid between the bag and the outside vessel.

However, the outside vessel, the meter or the instrument, and the pump provide a complex arrangement in the vicinity of the mattress. Particularly, if the outside vessel is positioned below the bag, the height of the resultant mattress becomes extremely high, thereby lowering the practically or utility of the mattress.

SUMMARY OF THE INVENTION

In light of the foregoing circumstances, a mattress is desired that is free from the foregoing drawbacks.

One aspect of the present invention pertains to a mattress having a sealed enclosure having an inner volume containing a fixed amount of fluid. An adjuster is provided exterior of the sealed enclosure for adjusting the firmness of the sealed enclosure without changing the fixed amount of fluid within the inner volume of the sealed enclosure.

According to a further aspect of the present invention, a mattress includes at least one sealed enclosure having an inner volume and containing an amount of fluid. An adjuster has a movable member that contacts and moves a surface of the enclosure to change a firmness of the mattress without changing the amount of fluid in the enclosure.

According to another aspect of the present invention, a mattress includes a sealed enclosure having an inner volume and containing a fixed amount of fluid. An adjusting device moves a portion of the enclosure with a member in contact with the enclosure to change a volume of the portion of the enclosure to change a firmness of the enclosure.

Another aspect of the present invention pertains to a mattress having a bag having an interior containing a fluid. An adjuster changes a firmness of the bag from a first firmness to a second firmness without supplying more fluid into the interior and without removing fluid from the interior. The adjuster also maintains the second firmness of the bag.

BRIEF DESCRIPTION OF THE DRAWINGS

The above and other objects, features, and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Preferred embodiments of the present invention will be described hereinafter in detail with reference to the accompanying drawings.

Figure 1:
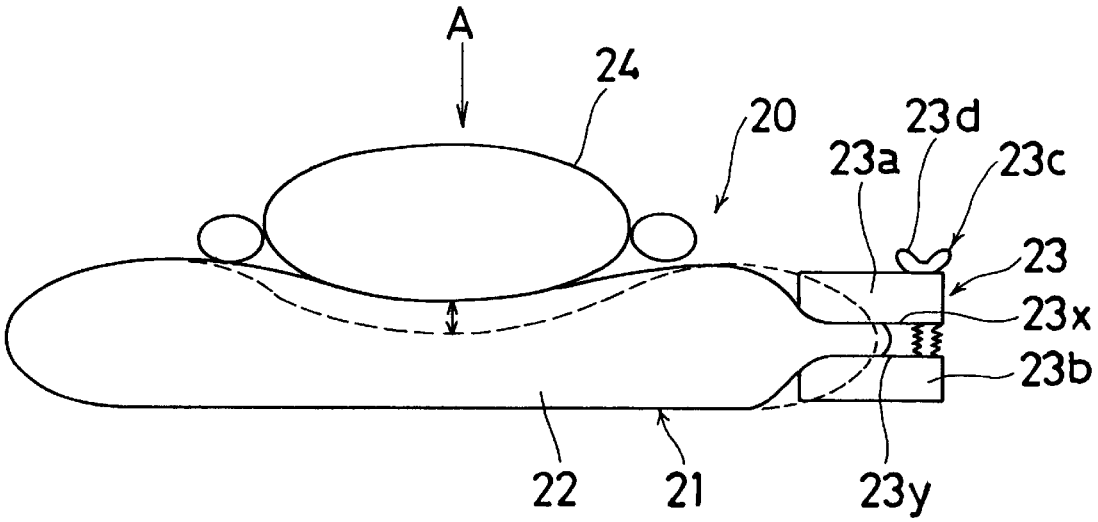
FIG. 1 is a cross-sectional view of a mattress of a first embodiment in accordance with the present invention.
Figure 2:
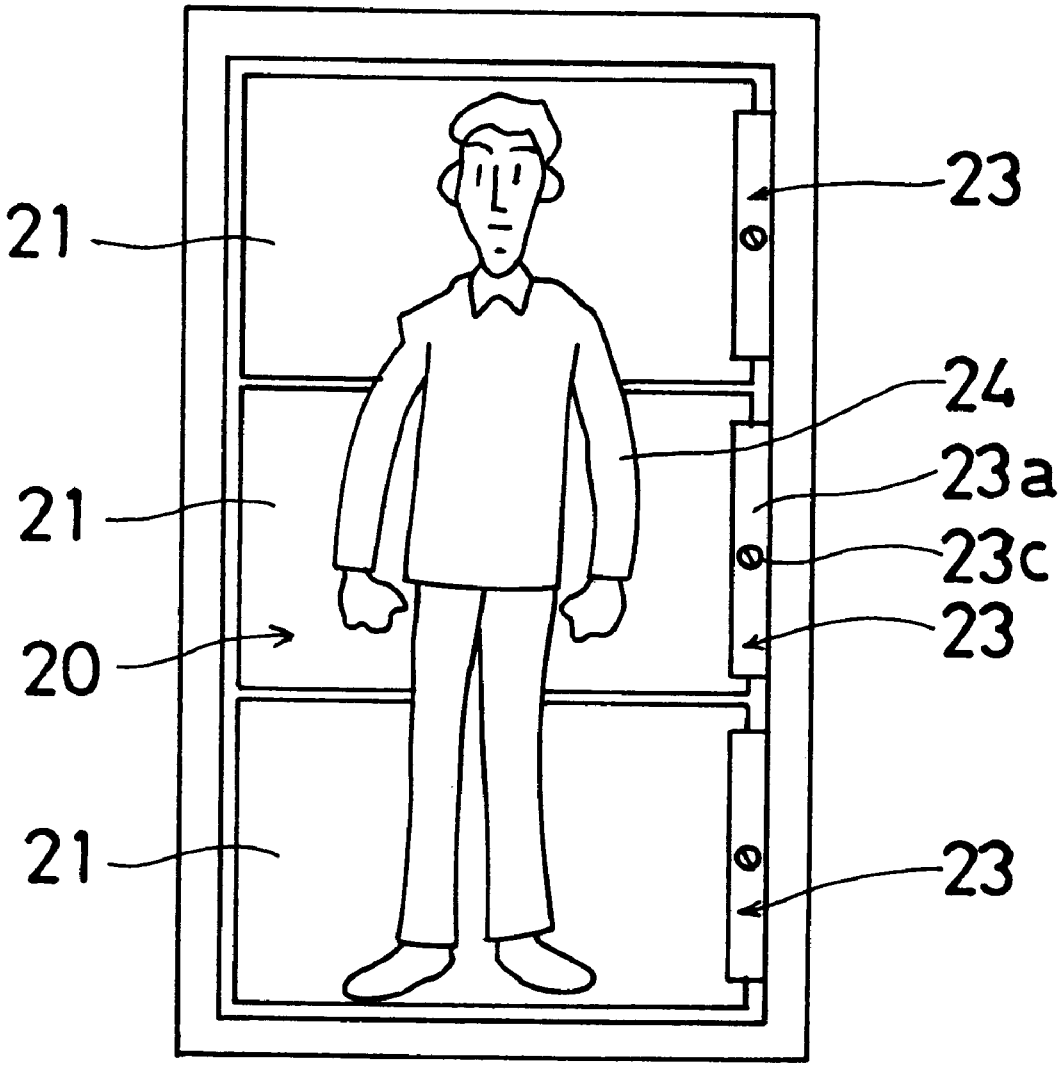
FIG. 2 is a top view of the mattress shown in FIG. 1.

Referring first to FIGS. 1 and 2, there is illustrated a mattress device 20 having a plurality of bags 21. As illustrated in FIG. 2, the mattress device 20 includes three bags 21. Each bag 21 is a box-like sealed enclosure having curved or rounded corners. Thus, each bag 21 generally includes a top surface, a bottom surface opposite from the top surface, and four side surfaces, which together define the interior or inner volume of each bag. As set forth below, the firmness, i.e, the softness or stiffness, of each bag 21 may be changed by forcibly moving a portion of the bag and then maintaining this moved portion at its moved location. The three bags 21 are disposed endwise in relation to one another for constituting an as-a-whole substantially rectangular body. Hence, the three bags 21 together define a rectangular-shaped mattress. The mattress device 20 can include more or less than the three bags 21 illustrated in FIG. 2.

Each of the bags 21 is filled with an amount of fluid, preferably a gelatinous material having a high viscosity. However, the bags 21 may be filled with other fluid and still function as contemplated herein. As illustrated in FIGS. 1 and 2, at a right or lateral side of each bag 21, an adjuster 23 is located that changes or modifies the outer three-dimensional configuration of the bag or at least a portion of the inner volume of the bag 21 to thereby adjusting an elasticity, i.e, firmness, of the bag, and thus the mattress 20.

The adjuster 23 illustrated in FIGS. 1 and 2 is a device which clamps the right side of the bag 21 to vary the inner volume of this portion of the bag with the amount of the gelatinous material in the bag remaining unchanged. That is, as shown in FIG. 2, the adjuster 23 includes a member that contacts a surface of the bag 21 and forces this surface to move relative to a previous location of the surface. Because the bag 21 is sealed and contains a fluid, this forced movement by the member of the adjuster 23 changes the fluid pressure and thus the firmness of the bag 21, even though the amount of fluid in the bag remains constant. Thus, the adjuster 23 moves a portion of the bag with a member in contact with the bag to change a volume of that portion of the bag where the adjuster is located to change a firmness of the bag.

In detail, the adjuster 23 has a pair of members, such as press plates 23 (upper press plate 23*a* and lower press plate 23*b*), which compress the outer surface of the bag 21 from the top and the bottom, respectively. The adjuster 23 further includes a pitch controller 23*c* which bridges the upper and lower plates 23*a* and 23*b*. The pitch controller 23*c* is in the form of a threaded or geared shaft which is threaded into both press plates 23*a* and 23*b*. A butterfly nut 23*d* is attached to or provided at an upper portion of the shaft on the plate 23*a*, which enables an increase and a decrease of a pitch or distance between the plates 23*a* and 23*b* when the butterfly nut 23*d* and shaft are rotated through an angle in one direction or the other direction, respectively.

The shaft can also be attached to one of the plates 23*a*, 23*b*. In this case, the nut 23*d* can be threaded on the shaft. Thus, rotation of the threaded nut with respect to the shaft will cause the plates 23*a*, 23*b* to clamp on or off the bag 21.

In order to ensure the foregoing pitch control between the plates 23*a* and 23*b*, a continual face-to-face engagement is established between the outer surface of the bag 21 and each of the plates 23*a* and 23*b*. That is, the plates 23*a*, 23*b* each contact the exterior surface of the bag 21 at the area where clamping occurs. To ensure contact, an inner or a lower surface portion 23*x* of the upper press plate 23*a* and an inner or a lower surface portion 23*y* of the lower press plate 23*b* are formed of a material having a high coefficient of friction. For example, the inner and lower portions 23*x*, 23*y* may have a higher coefficient of friction than the other surfaces of the press plates 23*a*, 23*b*.

As mentioned above, rotating the butterfly nut 23*d* causes a concurrent upward or downward movement of the shaft, thereby increasing or decreasing the pitch between the plates 23*a* and 23*b*, respectively. Such a rotation of the butterfly nut 23*d* can be established either manually or mechanically. In the latter case, a motor operated device can rotate the butterfly nut 23*d*. When the pitch between the plates 23*a* and 23*b* is decreased, the three-dimensional configuration or shape of the bag 21 changes from the shape represented by the phantom lines in FIG. 2 to the shape represented by the solid or real lines in FIG. 2. Hence, when at least one of or both of the plates 23*a*, 23*b* are moved toward each other, the shape of the bag is changed. For example, the top surface of the bag can expand outwardly from a very concave position to a less concave position, as shown in FIG. 1. In effect, moving the plates 23*a*, 23*b* toward one another forces the fluid in the bag located between the plates in a direction away from the plates to the other portion of the bag. Hence, when the plates 23*a*, 23*b* are moved toward each other, the existing fluid in the bag 21 is distributed within the bag so as to increase the firmness of the bag.

In this embodiment, the mattress 20 is divided into three bags 21 in such a manner that the elasticity or firmness of each bag 21 can be adjusted, regardless of the elasticity of the remaining bags 21. In other words, the mattress 20 establishes three different elasticity conditions in the lengthwise direction of the mattress, which can establish a suitable or desired backbone line configuration of a person 24 when he/she lays on the mattress 20.

It is to be noted that the number of the bags 21 can be set to 1, 2, or more than 3. Of course, the mattress 20 can be constituted by a sole bag. If such a structure is employed, the number of the adjusters 23 can be selected as desired. For example, a mattress having one bag 21 can have multiple adjusters 23 located at different locations of the bag. Additionally, each bag 21 of a multiple-bag mattress can have a plurality of adjusters 23 for varying the firmness of the bags. Each adjuster 23 can be also provided at a left side or other location of the bag 21. Moreover, the fluid to be filled or sealed as a liquid spring means in the bag 21 is not restricted to the gelatinous material mentioned above. Other suitable fluids will also suffice so long as the fluid functions as a liquid spring.

Figure 3:
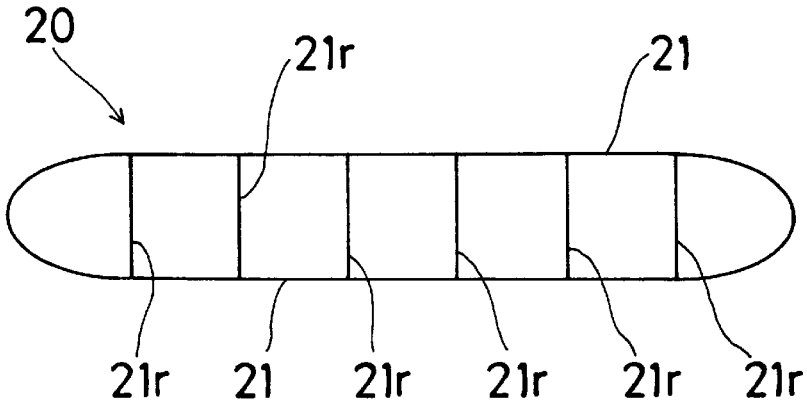
FIG. 3 is a cross-sectional view of an inner structure of a desired bag.

In addition, for preventing an excess depression of each the bag 21 when the person lays on the mattress 20, as shown in FIG. 3, each of the bags 21 preferably includes a plurality of reinforcements, such as laterally spaced ribs 21*r* that extend in the vertical direction and connect upper and lower sides of the bag 21. Of course, even though such a construction is employed, each segment or area between the ribs 21*r* is preferably in fluid communication with other areas or segments. That is, the areas between the ribs 21*r* are in fluid communication with each other and contribute to the inner volume of the bag 21.

Figure 4:
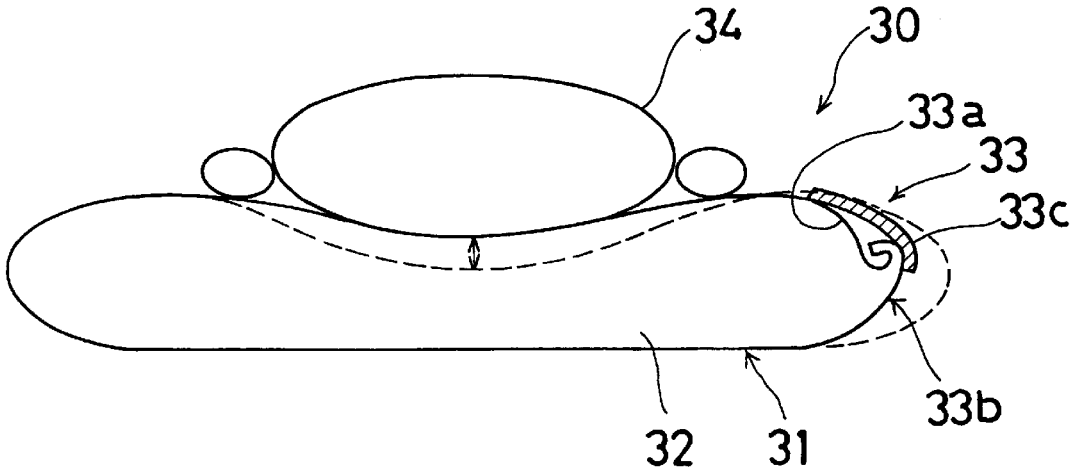
FIG. 4 is a cross-sectional view of a mattress of a second embodiment in accordance with the present invention.

Referring next to FIG. 4, another embodiment of a mattress device 30 is illustrated. The mattress device 30 includes three bags 31 (only one is shown) in which an amount of gelatinous material 32 is sealed. At a right side of the bag 31, there is provided an adjuster 33 for changing the firmness of the bag 31. The adjuster 33 changes the outer three-dimensional configuration or an inner volume of the bag 31 to thereby adjust an elasticity of the mattress 30. As described below, the adjuster 33 includes a member, like the adjuster 23, which moves a surface of the bag to change the stiffness of the mattress 30.

Due to the fact that an overall structure of the mattress 30, the bag 31, and the gelatinous material 32 are identical to those of the first embodiment shown in FIG. 1, the following explanation is focused on the features of the adjuster 33 that differ from the foregoing adjuster 23 in construction and operation.

The adjuster 33 has a bridge member 33*c*, an upper tie member 33*a*, and a lower tie member 33*b*. The upper tie member 33*a* and the lower tie member 33*b* are provided on an upper portion and a lower portion of the right side of the bag 31, respectively. For example, the upper and lower tie members 33*a*, 33*b* can be attached to the exterior surface of the bag 31, such as by a bonding agent, or can be integrally formed with the bag 31. The upper and lower tie portions 33*a*, 33*b* can be spaced from each other along the circumference of the bag, or may contact each other.

An upper or proximal portion of the bridge member 33*c* is secured to the upper tie member 33*a*. For example, the upper portion of the bridge member 33*c* may be glued to or integral with the upper tie member 33*a*. The bridge member 33*c* descends to an area adjacent the lower tie member 33*b* in such a manner that the lower or distal end of the bridge member 33*c* is attachable to the lower tie member 33*b*. The lower end of the bridge member 33*c* can be attached in a detachable manner, preferably a Velcro manner, to any desired or arbitrary portion of the lower tie member 33*b*. That is, the bridge member 33*c* and the lower tie member 33*b* can be attached to each other by hook and loop fasteners provided on the bridge member and lower tie member. The bridge member 33*c* can also be attached to the lower tie member 33*b* by other fasteners. For example, the bridge member 33*c* and the lower tie member 33*b* can include snap fasteners or a buckle fastener. The foregoing attachments between the bridge member 33*c* and the lower tie member 33*b* enables an overlay structure between the upper tie member 33*a* and the lower tie member 33*b* wherein an overlapped area therebetween is adjustable to change an inner volume or an outer three-dimensional configuration of the bag 31.

For example, as illustrated in FIG. 4, portions of the lower tie member 33*b* and the upper tie member 33*a* can be rolled, folded, or bent toward the interior of the bag and then forced to stay in this overlapped position by attaching the distal portion of the bridge member 33*c* to the lower tie member 33*b*. This will force fluid in the bag 31 located between the tie members 33*a*, 33*b* in a direction away from the tie members 33*a*, 33*b* such that the fluid is redistributed in the bag so as to increase the firmness the bag. The three-dimensional configuration of the bag 31 when the lower end of the bridge member 33*c* is out of engagement, i.e., disengaged, with the lower tie member 33*b* is depicted by the phantom line in FIG. 4, while the three-dimensional configuration of the bag 31 when the lower end of the bridge member 33*c* is in engagement with the lower tie member 33*b* is depicted by the solid or real lines in FIG. 4.

The invention has thus been shown and description with reference to specific embodiments. However, it should be understood that the invention is in no way limited to the details of the illustrated structures. Changes and modifications may be made without departing from the scope of the appended claims.

What is claimed is:

1. A mattress comprising:

a sealed enclosure having an inner volume containing a fixed amount of fluid, the enclosure including a plurality of reinforcements; and an adjuster provided exterior of the sealed enclosure for adjusting the firmness of the sealed enclosure without changing the fixed amount of fluid within the inner volume of the sealed enclosure.

2. A mattress as set forth in claim 1, wherein the adjuster includes a clamp for clamping a portion of the sealed enclosure.

3. A mattress as set forth in claim 2, the clamp includes means for varying an amount of clamping.

4. A mattress as set forth in claim 1, wherein the adjuster includes a pair of spaced apart plates between which a portion of the enclosure is held and a connecting member connecting the plates.

5. A mattress as set forth in claim 4, wherein the connecting member is configured to adjust a pitch between the plates.

6. A mattress as set forth in claim 5, wherein the connecting member includes a shaft threaded to the plates.

7. A mattress as set forth in claim 6, further comprising a butterfly nut threaded on one end of the shaft.

8. A mattress as set forth in claim 4, wherein a surface of said portion of the enclosure located between said plates has a coefficient of friction that is higher than a coefficient of friction of another surface of the enclosure.

9. A mattress as set forth in claim 8, a surface of each said plates facing said portion of the enclosure includes a coefficient of friction that is higher than a coefficient of friction of another surface of the plates.

10. A mattress as set forth in claim 1, wherein the adjuster includes a bridge member that defines an overlay structure between a first outer part and a second outer part of a portion of the enclosure.

11. A mattress as set forth in claim 10, wherein the bridge member connects the first outer part to the second outer part with a hook and loop fastener.

12. A mattress as set forth in claim 1, wherein the reinforcements are laterally spaced and vertically extending ribs that connect upper and lower sides of the enclosure.

13. A mattress as set forth in claim 12, further comprising a plurality of adjusters.

14. A mattress as set forth in claim 1, wherein the adjuster is located at a lateral side of the enclosure.

15. A mattress as set forth in claim 1, wherein the fluid is a gelatinous material.

16. A mattress comprising:

at least one sealed enclosure having an inner volume and containing an amount of fluid, the enclosure including a plurality of reinforcements; and an adjuster having a movable member for contacting and moving a surface of said enclosure to change a firmness of the mattress without changing the amount of fluid in the enclosure.

17. A mattress comprising:

a sealed enclosure having an inner volume and containing a fixed amount of fluid, the enclosure including a plurality of reinforcements; and an adjusting means for moving a portion of the enclosure with a member in contact with the enclosure to change a volume of said portion of said enclosure to change a firmness of said enclosure.

18. A mattress comprising:

a bag having an interior containing a fluid, the bag having a plurality of reinforcements;

an adjuster for changing a firmness of said bag from a first firmness to a second firmness without supplying more fluid into said interior and without removing fluid from said interior, said adjuster also for maintaining said second firmness of said bag.

19. The mattress of claim 18, wherein said adjuster includes at least one member for clamping a portion of said bag to change the firmness of said bag from the first firmness to the second firmness.

20. The mattress of claim 18, wherein said adjuster includes at least one member for folding a portion of said bag to change the firmness of said bag from the first firmness to the second firmness.

* * * * *